US009089464B2

(12) United States Patent
Van Oirschot

(10) Patent No.: US 9,089,464 B2
(45) Date of Patent: Jul. 28, 2015

(54) PATIENT LIFTING DEVICE

(71) Applicant: Frank Van Oirschot, Chatham (CA)

(72) Inventor: Frank Van Oirschot, Chatham (CA)

( * ) Notice: Subject to any disclaimer, the term of this patent is extended or adjusted under 35 U.S.C. 154(b) by 0 days.

(21) Appl. No.: 13/912,726

(22) Filed: Jun. 7, 2013

(65) Prior Publication Data

US 2013/0269103 A1 Oct. 17, 2013

Related U.S. Application Data

(63) Continuation-in-part of application No. 12/626,662, filed on Nov. 26, 2009, now abandoned.

(30) Foreign Application Priority Data

Nov. 27, 2008 (CA) ..... 2645428

(51) Int. Cl.
*A61G 7/10* (2006.01)
*A61G 7/05* (2006.01)

(52) U.S. Cl.
CPC ..... *A61G 7/1025* (2013.01); *A61G 7/1011* (2013.01); *A61G 7/1015* (2013.01); *A61G 7/1036* (2013.01); *A61G 7/1046* (2013.01); *A61G 7/1057* (2013.01); *A61G 7/1026* (2013.01); *A61G 2007/0518* (2013.01); *A61G 2200/32* (2013.01); *A61G 2200/34* (2013.01)

(58) Field of Classification Search
CPC ..... A61G 1/013; A61G 7/103; A61G 7/1057; A61G 7/1011; A61G 7/1026; A61G 1/04; A61G 2007/051; A61G 3/061
USPC ..... 5/610, 81.1 R, 83.1, 88.1, 81.1 C, 5/81.1 HS, 86.1; 414/921; 254/88, 10 B, 254/2 C, 93 H, 122, 124, 126, 134; 297/DIG. 10
See application file for complete search history.

(56) References Cited

U.S. PATENT DOCUMENTS

| | | | | |
|---|---|---|---|---|
| 4,262,375 | A * | 4/1981 | Lilienthal | 5/81.1 HS |
| 5,148,558 | A * | 9/1992 | Dunn | 5/81.1 T |
| 5,280,657 | A * | 1/1994 | Stagg | 5/81.1 R |
| 6,139,567 | A * | 10/2000 | McCarty et al. | 606/237 |
| 6,289,536 | B1 * | 9/2001 | Betson | 5/618 |
| 6,916,056 | B2 * | 7/2005 | Mitchell et al. | 296/20 |
| 8,740,304 | B2 * | 6/2014 | Yu | 297/330 |
| 2004/0221388 | A1 * | 11/2004 | Votel | 5/81.1 HS |
| 2005/0138727 | A1 * | 6/2005 | Faux et al. | 5/81.1 R |
| 2006/0260054 | A1 * | 11/2006 | Lubbers et al. | 5/621 |
| 2006/0279131 | A1 * | 12/2006 | Kraenzle | 298/12 |
| 2007/0017029 | A1 * | 1/2007 | Wurdeman | 5/618 |
| 2007/0118990 | A1 * | 5/2007 | Kuenzel | 5/618 |

* cited by examiner

*Primary Examiner* — Robert G Santos
*Assistant Examiner* — Myles Throop

(57) ABSTRACT

An inclined lift for patient transfer is designed to allow a patient to be pulled on an inclined ramp which is subsequently movable to a raised generally horizontal position. IN the raised generally horizontal position a patient may be transferred to a chair or to a further horizontal structure such as a bed. In a preferred embodiment the inclined lift includes a patient slide mat that is movable onto the ramp by a retraction mechanism. The patient sits or lies on the mat and a winch type mechanism pulls the mat onto the inclined ramp. There is no requirement for a patient harness to directly pull the patient onto the inclined ramp.

19 Claims, 21 Drawing Sheets

PATIENT LIFTING DEVICE

The present application is a continuation-in-part of application Ser. No. 12/626,662 filed on Nov. 26, 2009.

FIELD OF THE INVENTION

The present invention relates to patient lift arrangements.

BACKGROUND OF THE INVENTION

The present invention provides an effective lift arrangement for transferring a patient from ground level to a raised level, and allows for subsequent transfer to an appropriate support.

A number of different devices have been proposed, primarily for hospital or institutional-type settings, where a patient is transferred from a wheel chair to a bed or from a wheel chair to a bath. With these devices the patient is effectively lifted and suspended to affect transfer. Such lifting mechanisms assist the care provider in completing the transfer without manual lifting. In recent years there has been a desire to provide proper care for patients in their own home environment as opposed to an institutional setting. One of the difficult challenges for a care provider in the home environment is the lifting of the patient from ground level to an appropriate support such as a chair or bed. Many patients are not capable of lifting themselves to a suitable support structure safely, and the existing lifting-type mechanisms have not been optimized for home use.

SUMMARY OF THE INVENTION

An inclined lift for patient transfer according to the present invention comprises a base frame supporting an elongate patient support platform that is moveable between an inclined position with one end thereof adjacent ground level and the opposite end at a raised level to a raised position of the platform with both ends of the platform elevated at least 15 inches. The lift further includes a retraction mechanism with a free end thereof engageable with a patient support arrangement. The retraction mechanism is operative to draw the patient support arrangement from ground level in front of the platform when in the inclined position onto the inclined platform which can then be moved to the elevated position.

In a preferred aspect of the invention, the inclined patient lift includes a winched-type arrangement as the retraction mechanism.

According to a further aspect of the invention, the patient support arrangement is a flexible mat with a draw bar member at one end thereof attachable to the retraction mechanism.

In a further aspect of the invention, the flexible mat at an end thereof adjacent the draw bar has a series of strip portions extending in the length of the flexible mat a sufficient distance to assist in removal of the mat supporting a patient on the platform. The draw bar member is removed and this allows the strips to be individually removed from beneath the patient. In a preferred embodiment, the strips are approximately three inches wide and of a length of at least twenty inches.

In yet a further aspect of the invention, the flexible mat at an end thereof adjacent the draw bar has a series of strip portions extending in the length of the flexible mat a sufficient distance to assist in the removal of the mat supporting a patient on said strip portions by progressive removal of the strip portions.

In a further aspect of the invention, the patient support platform includes a first elevating mechanism connecting the base frame and the patient support platform, and operable to raise and lower the one end of the platform between the inclined position and the raised position.

In a further aspect of the invention, the opposite end of the patient support platform is also vertically adjustable relative to the base frame.

According to an aspect of the invention, the one end of the platform can be raised to a slightly higher position than the opposite end of the platform in the raised position. This provides a slope to the opposite end to assist in transfer of the patient by movement along the platform and through the opposite end.

In yet a further aspect of the invention, the incline lift includes removable side rails located on opposite sides of the patient platform.

In yet a further aspect of the invention, the incline lift includes an elevating mechanism associated with both ends of the platform and remote actuators for these elevating mechanisms.

In a preferred aspect of the invention, the patient support platform includes a moveable extension secured to the patient support platform and projecting beyond the base frame that forms the one end of the patient support platform. This moveable extension provides a transition engageable with the floor for movement of the patient onto the patient support platform that is directly above the base frame.

In a further aspect of the invention, the moveable extension is pivotally secured to the patient support platform, and is moveable between an extended position extending beyond the base frame to a storage position overlapping with the patient support platform above the base frame.

In yet a further aspect of the invention, the base frame provides the support for the retraction mechanism and the elevating mechanisms used in the lift.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
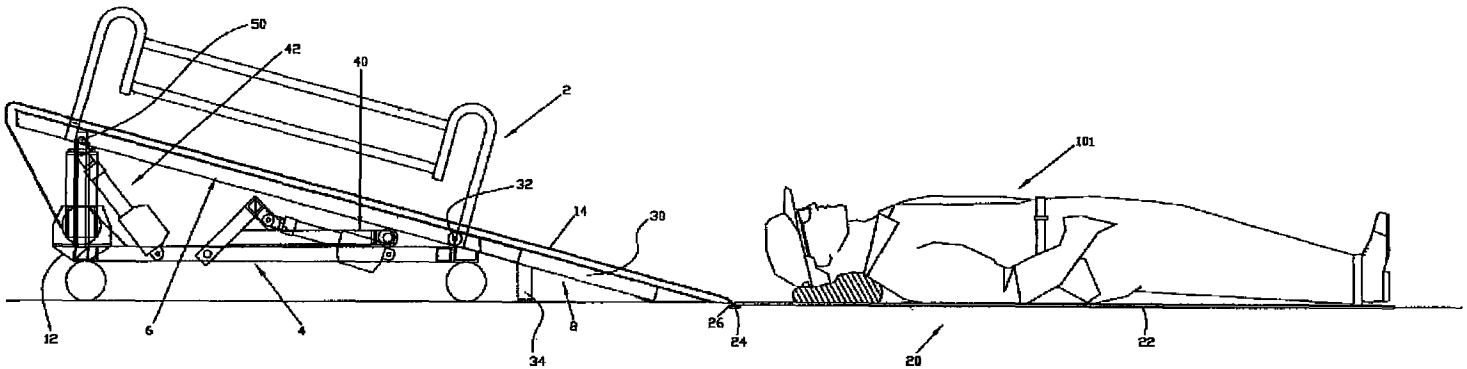
FIG. 1 is a side elevation showing the inclined lift being used to transfer a patient from ground level onto the lift.

The inclined lift 2 includes a base frame 4 supporting the elongate patient support platform 6 thereabove. The inclined lift as shown in FIG. 1 is positioned in front of a patient 101 who is in a horizontal position supported on the floor. The flexible mat 22 forms the patient support structure and is positioned beneath the patient 101. To accomplish this, the patient can roll to one side allowing the mat to be inserted beneath the patient, and the patient can then shift on the mat to be longitudinally centered. The mat 22 includes a pocket 26 at one end thereof that receives the removable draw bar 24. The removable draw bar 24 is connected to the retraction strap 14 which is part of the retraction mechanism 12 supported above the base frame 4. Actuation of the retraction mechanism 12 draws the patient support mat 22 onto the inclined elongate patient support platform 6.

Figure 2:
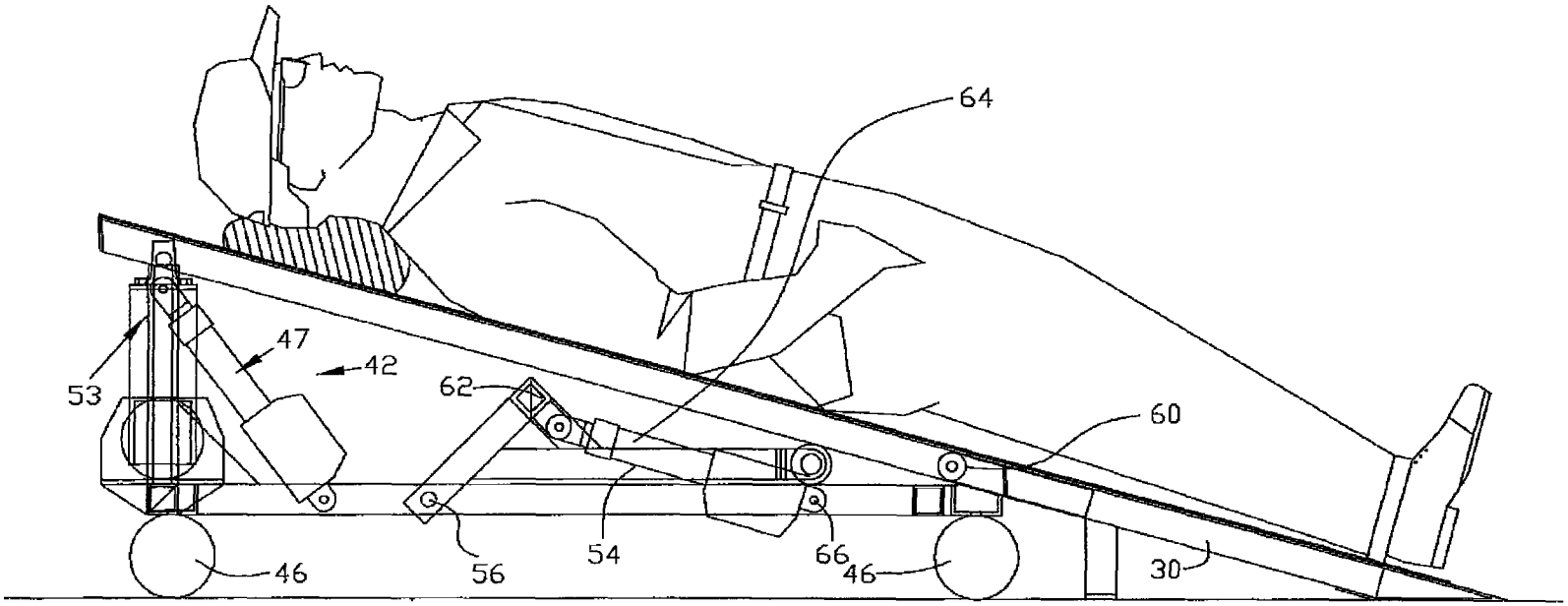
FIG. 2 shows the inclined lift with the patient now supported on the lift.

The elongate patient support platform 6 as shown in FIG. 1 includes a moveable extension 30 that is preferably pivotally secured either side of the platform by the pivot connection 32. The moveable extension 30 includes intermediate its length a ground support leg 34. This moveable extension forms a transition of the elongate patient support platform from ground level onto the patient support platform that is centered above the base frame 4. Operation of the retraction mechanism 12 will cause the retraction strap 14 to pull on the draw bar member 24 and pull the flexible mat 22 onto the patient support platform. Further retraction of the retraction mechanism 12 will allow the patient 101 to be fully drawn onto the inclined lift as shown in FIG. 2. Basically, the flexible mat has relatively low friction with the support surface, and with the patient support platform to allow effective movement of the patient from the horizontal position supported on the floor as shown in FIG. 1 to the support position as shown in FIG. 2.

As illustrated with respect to FIG. 2, the base platform is such that most of the patient's weight and the patient's center of gravity will be located on the platform above the base frame 4. This provides effective weight distribution of the patient on the patient support platform, and a stable arrangement as the base frame is effectively supported at opposite ends thereof. The majority of the patient's weight is carried within the length of the base frame. It can also be seen that essentially the patient's legs are only supported on the moveable extension 30.

Figure 3:
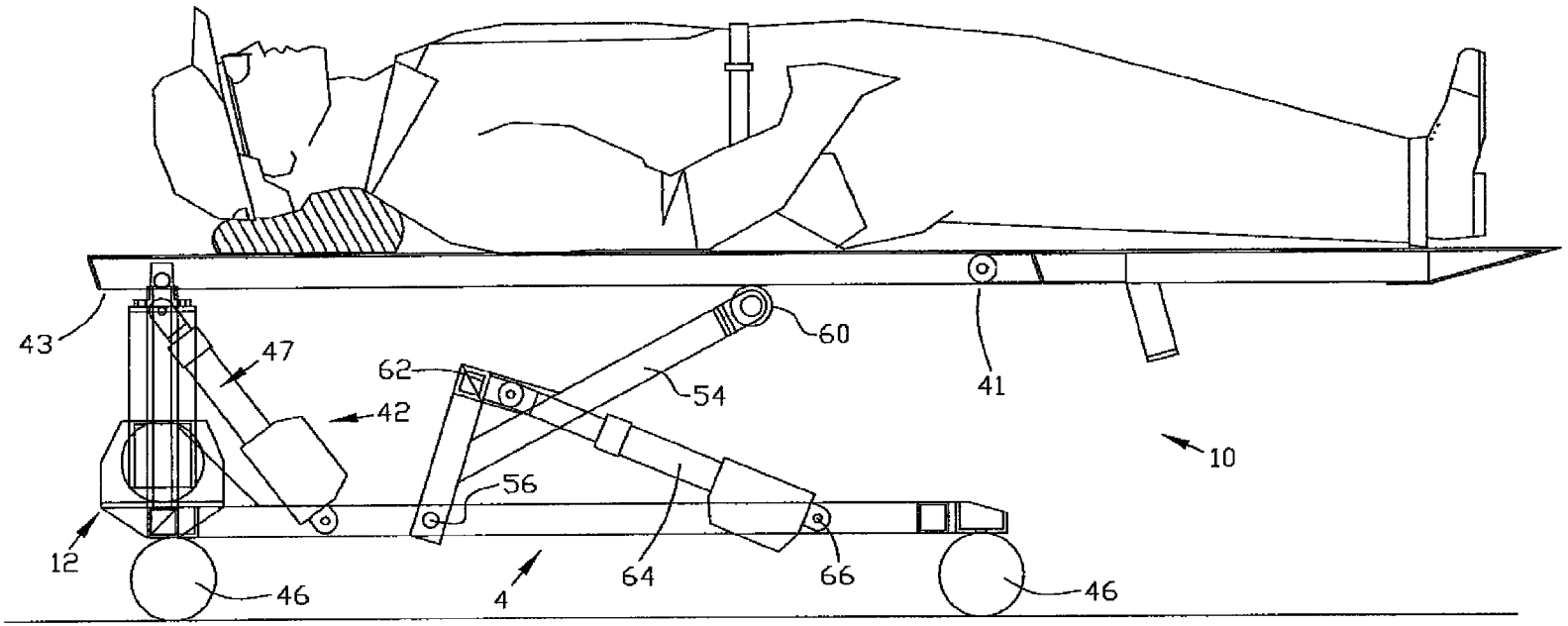
FIG. 3 shows the inclined lift with the platform now moved to a raised patient support position.

The base frame 4 includes a first elevating mechanism 40 raises the end 41 of the patient support platform 6 to the raised position shown in FIG. 3. Preferably, this elevating mechanism will also allow further raising of the one end 41 to the reverse inclination position of FIG. 4. This reverse inclination provides a shallow angle that will assist in the transfer of the patient 101 from the inclined lift by movement through the opposite end 43 of the inclined lift as will be explained in subsequent figures.

Figure 4:
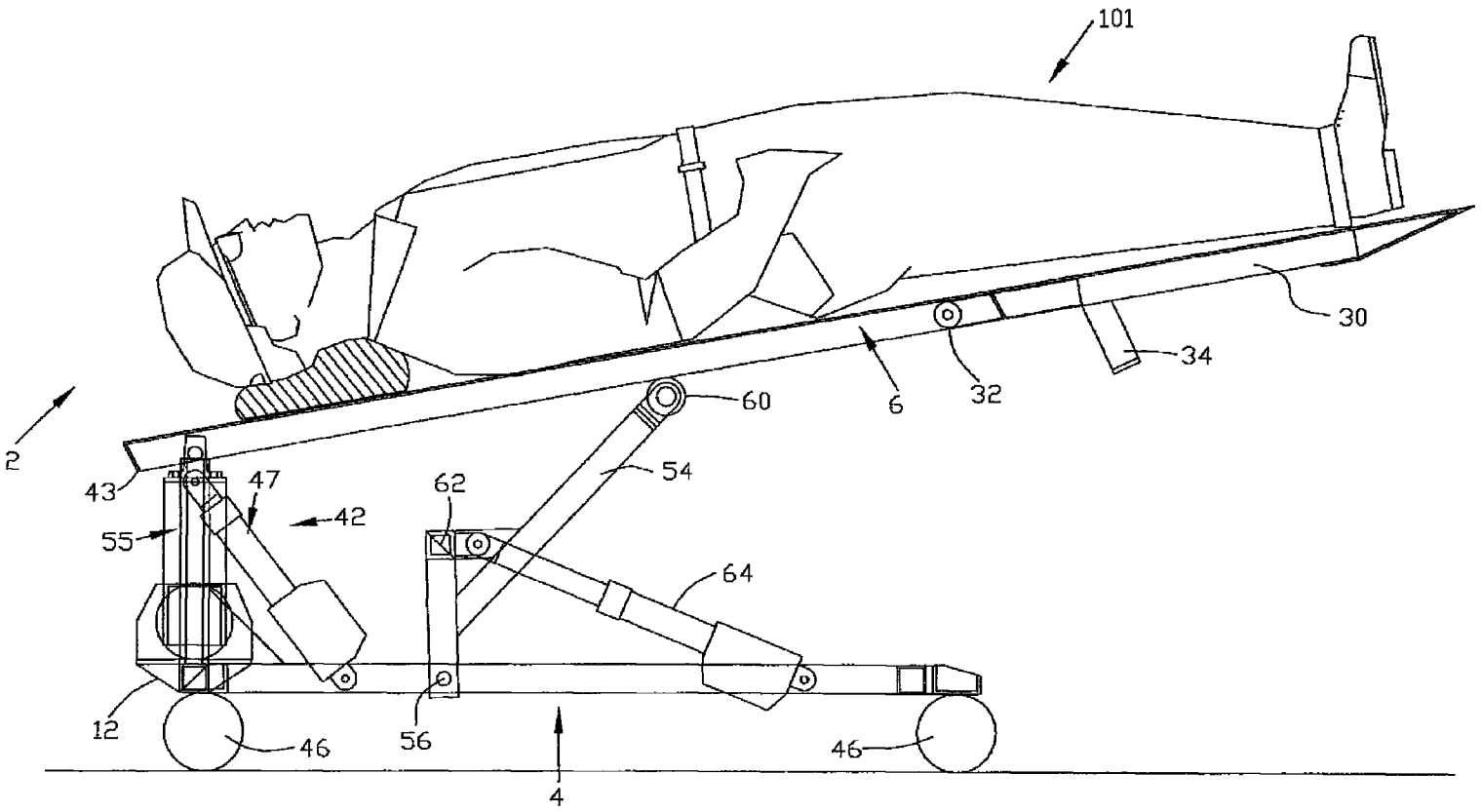
FIG. 4 shows the elevated platform with further movement of the platform to allow for a reverse of inclination of the platform to assist in transfer of the patient.
Figure 5:
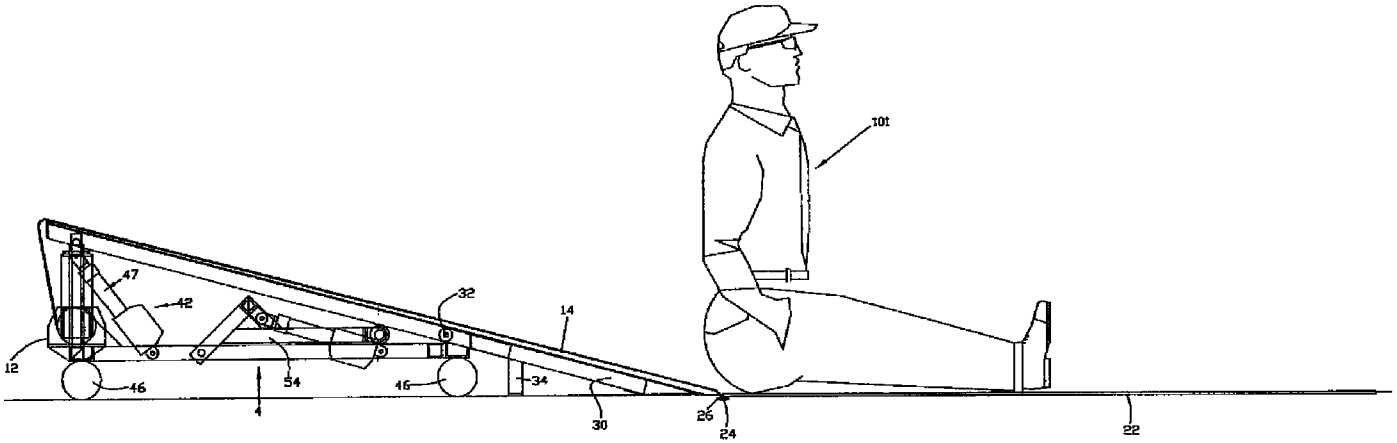
FIGS. 5 through 8 show the inclined lift in side view and show the various steps for moving of a patient in a sitting position on the floor to the final reverse inclination of the inclined lift in FIG. 8 (this particular position allows effective transfer of a patient longitudinally of the inclined lift)
Figure 6:
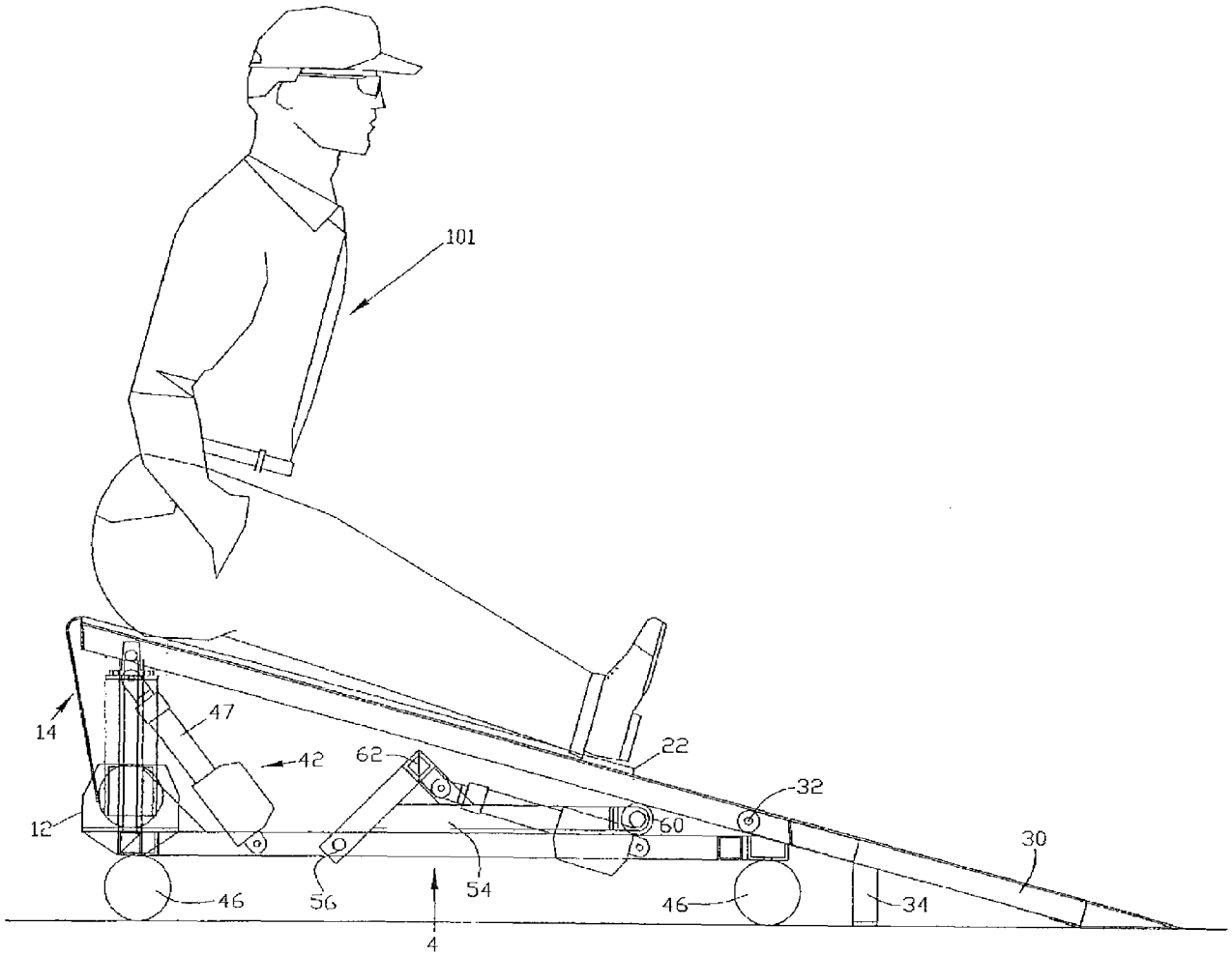
Figure 7:
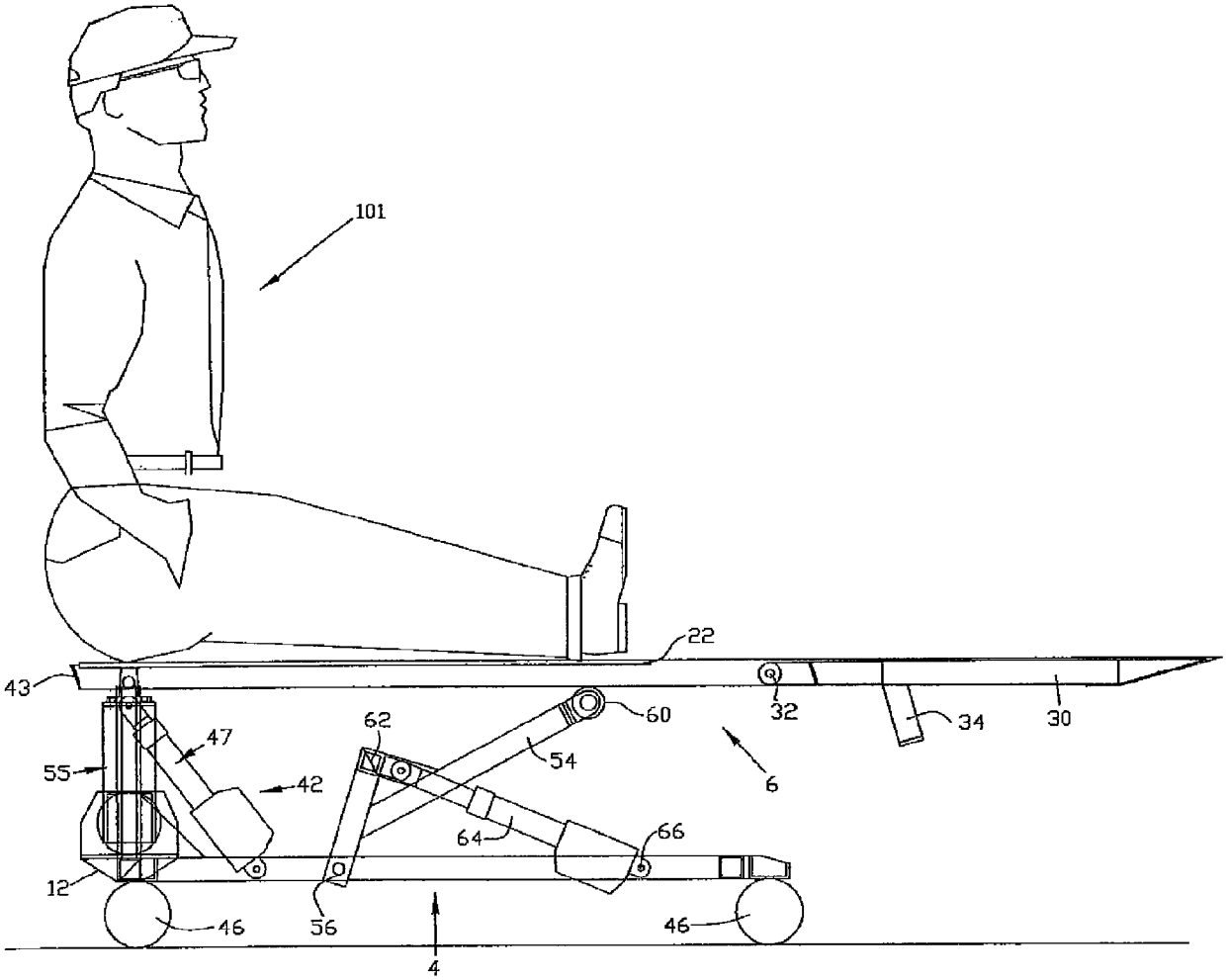
Figure 8:
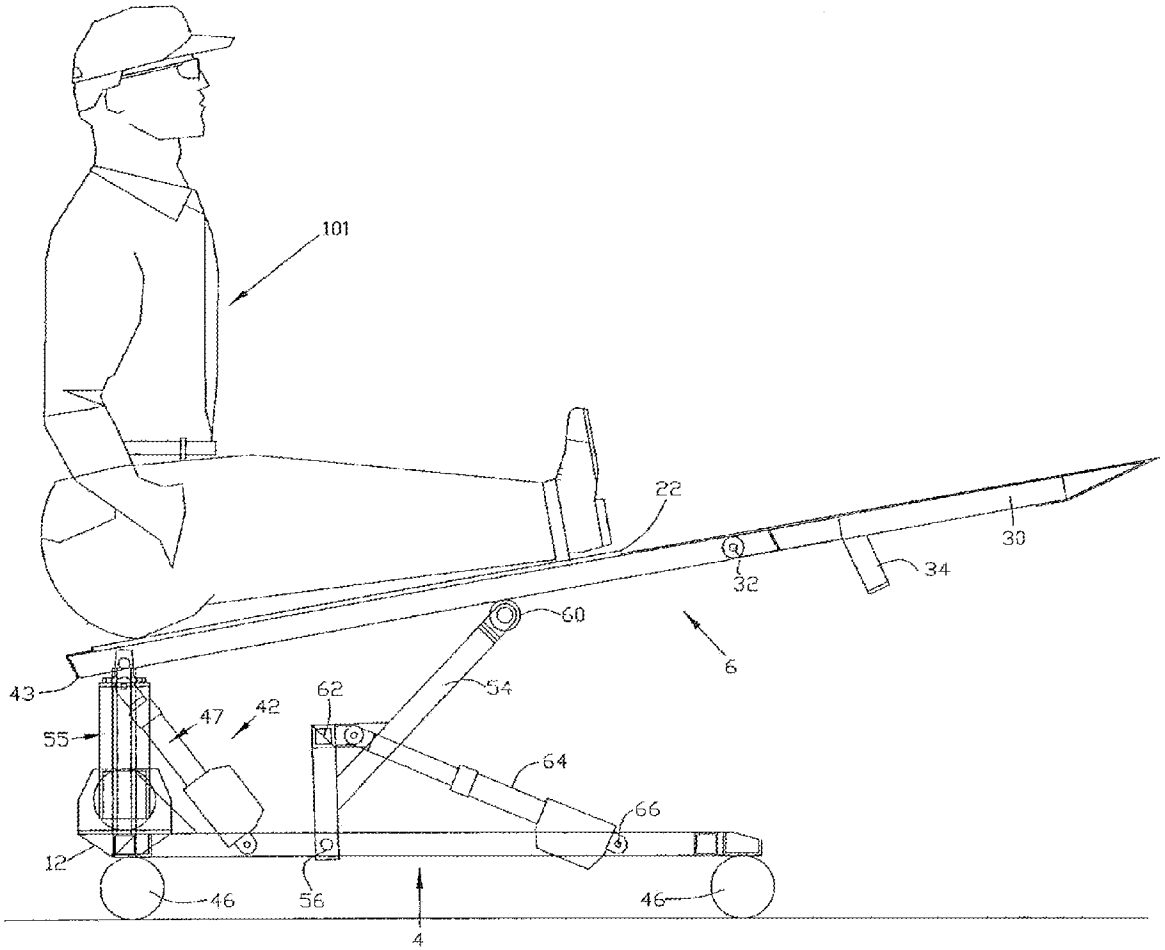

The base frame 4 also includes a second elevating mechanism 42 for vertical adjustment of the end 43 of the platform 6. This simplifies transfer of the patient to an appropriate support structure. For example, it may be desirable to transfer the patient to a wheelchair. Typically, wheelchairs are at different heights between 18 and 24 inches from the ground level to suit the patient. The second elevating mechanism allows appropriate movement of the end 43 such that it is at the approximate height of the support structure to which the patient will be transferred. The ability of the second mechanism to move to the reverse inclination position as shown in FIG. 4 and FIG. 8 provides assistance in transferring of the patient as gravity will allow the patient to partially slide or move along the length of the platform.

The base frame 4 includes support wheels 46 to allow movement of the incline lift to different locations in the premise. These wheels are lockable, or an arrangement for effectively braking of the platform to allow transfer of a patient onto the inclined lift is provided.

The first elevating mechanism 40 is shown as a linkage arrangement that includes an elevating link 54 having a roller 60 for movement along the lower surface of the patient support platform 6. The elevating link 54 is also pivotally connected to the base frame 4 at the pivot connection 56 and has an associated offset arm 62. An actuator 64 in the form of an adjustable length lever is operative to effect the lifting of the platform from the inclined position of FIG. 2 to the raised position and the reverse inclination positions of FIGS. 3 and 4. The opposite end of the platform is also adjustable in height by the second elevating mechanism 42. This includes an adjustable link member 54 that can extend and force the end of the platform 43 to move vertically within telescopic members 53 supporting the one end of the platform. In this way the end 43 can also be moved and it is preferred that this end of the platform has a range of motion of approximately six or more inches.

As can be appreciated from FIGS. 1 through 8, the incline lift includes a base frame 4 that is of a shorter length than the overall length of the patient support platform 6. Once a patient has been appropriately drawn onto the patient support platform 6, the patient's weight is effectively directly above the base frame and thus provides a stable support. With this inclined lift, the patient is drawn onto the patient support platform by movement in the length of the platform, and the patient can also be transferred by movement through the opposite end 43 of the platform.

Different elevating mechanisms and different retraction mechanisms can be used.

FIGS. 5 through 8 also use the flexible mat structure for effecting transfer of a patient in a sitting position on the floor onto the inclined lift. In this case, the patient prefers to effect transfer in the sitting position, and is again drawn onto the inclined lift. The patient's weight is still effectively supported within the base frame 4 once the patient has been appropriately positioned on the platform.

Figure 10:
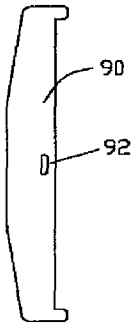
FIG. 10 is a top view of the removable draw bar.
Figure 9:
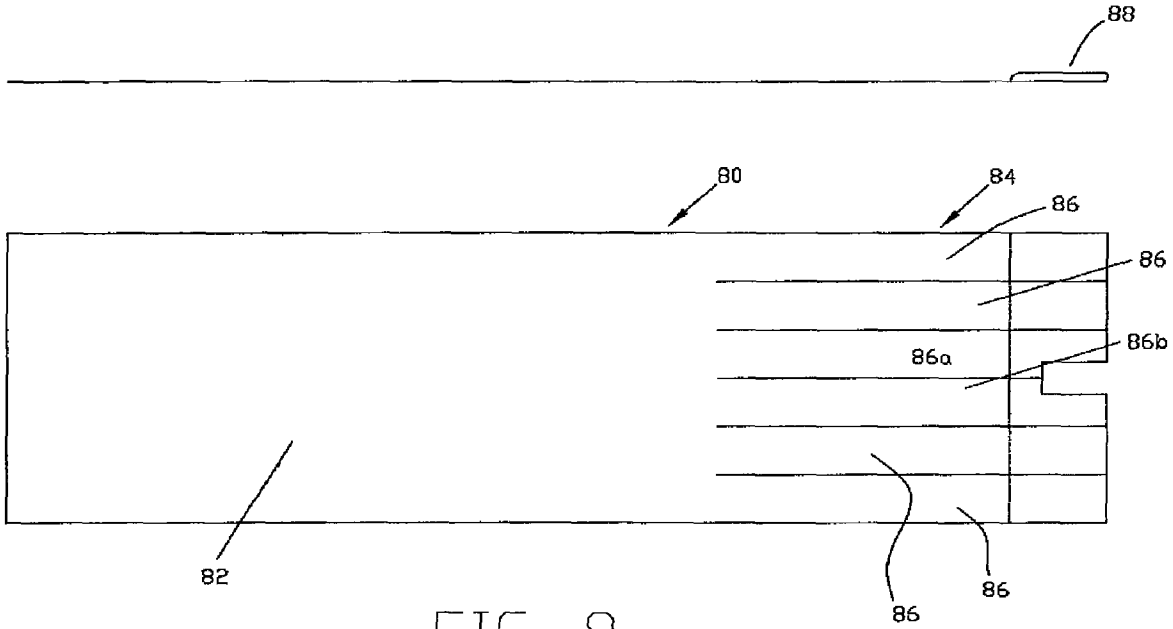
FIG. 9 is a top view of the slidable mat.

Details of the flexible mat and its connection to the retraction mechanism are shown in FIGS. 9 and 10. The mat 80 is a flexible structure and is of appropriate strength and properties for sliding along a support surface and onto the patient support platform. It includes a non stripped portion generally shown as 82, and a stripped end portion shown as 84. The end 84 includes individual strips shown as 86. The drawbar 90 is insertable into the pocket 88 provided at the one end of the flexible mat. This drawbar includes a connection portion 92 for engagement with the retraction mechanism. Preferably, strips 86*a* and 86*b* are partially cut away to allow convenient connection of the drawbar 90 to the retraction mechanism. The strip portions 86 are preferably of a length of at least twenty inches and approximately three inches in width. The lengths of the strips can be increased, and may be as long as thirty six inches. The advantage of the strips is that with the patient on the inclined lift, it may be desirable to remove the flexible mat. In this case, the drawbar 90 can be removed, and the individual strips progressively pulled from beneath the patient. This simplifies the removal of the mat and allows for more convenient use of the lift.

The mat can be made as a two layer construction with a lower surface having properties to provide good durability and appropriate friction for allowing the mat to slide across a floor. The frictional properties are preferably a compromise to allow stability as a patient is getting on the mat while allowing sliding of the mat along a surface and onto the inclined lift. The bottom surface of the mat can be ribbed to reduce the contact area. Although low friction characteristics are desired for sliding movement, inadvertent sliding movement on the support surface and/or on the inclined lift due to patient movement should be avoided.

The top surface of the mat is of a coarser material to prevent the patient from sliding on the mat during loading onto the inclined lift.

It can be appreciated from the drawings that the incline lift is relatively simple in structure and safe in operation to affect transfer of a patient onto the inclined patient platform from one end of the platform, and allows transfer of the patient to a chair or other support from an opposite end of the platform once the platform has been appropriately elevated.

The patient platform preferably has removable rails either side thereof and in a further embodiment, a bed transfer member is connectable along either side of the platform. This bed transfer member 120 is connectible to the support platform using the same connection points of the removable rail. In this case, the inclined lift, with a patient thereon and at a raised position, can be appropriately adjusted to bring the bed transfer member to the appropriate height of the bed and supported on the bed. This can be accomplished by adjustment of the two elevating mechanisms. Once this has been accomplished, the patient can then slide or move onto the bed support structure by movement through the one side of the platform. The device remains stable as the bed provides the support for the transfer when the patient is in an offset position relative to the base 4.

Figure 11:
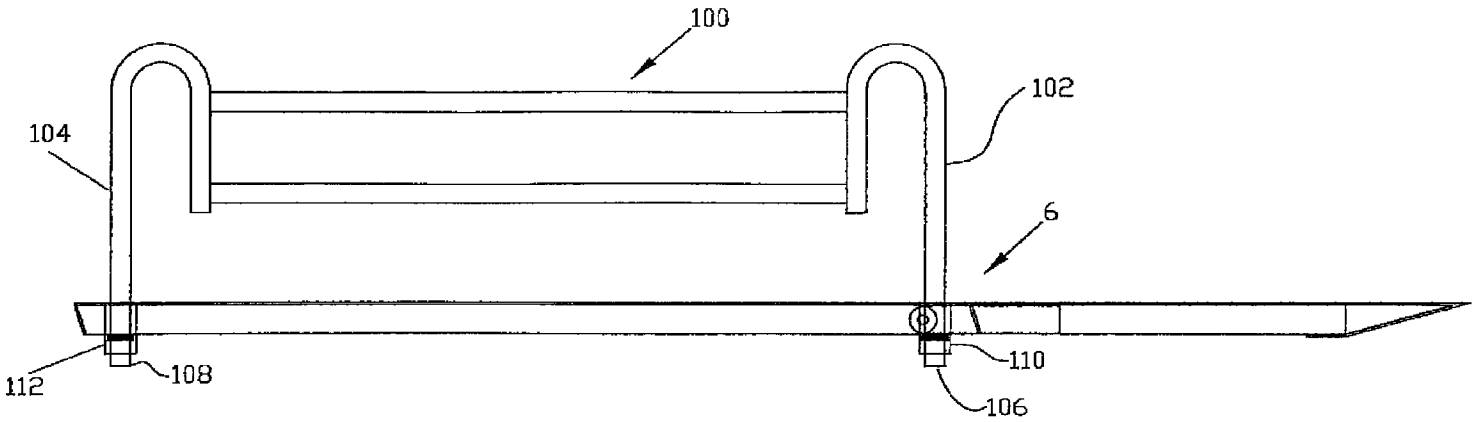
FIG. 11 is a partial side view of a side rail of the inclined lift.

FIG. 11 shows the handrail 100 and its relationship to the patient support platform 6. The handrail 100 includes a support tube 102 at one end thereof, and a similar support tube 104 at the opposite end thereof. Preferably, the handrail is reversible.

The handrail 100 is releasably secured to the patient support platform 6 in that the support tubes 102 and 104 are received within a short stub tube shown as 110 and 112. Basically, the support tubes 102 and 104 bottom out within the stub support tubes 110 and 112.

The free end of each of the support tubes 102 and 104 includes a drop hinge member 106 and 108 respectively. The drop hinge member 106 and 108 allows the handrail to be moved partially upwardly such that the pivot axes 107 and 109 are above the top edge of the stub tubes 110 and 112, allowing the handrail to pivot outwardly to a perpendicular type orientation. This allows the handrail to move to a position where it could be supported on an adjacent bed. As can be appreciated from FIG. 12, when the support tubes 102 and 104 are fully received within the stub tubes 110 and 112, the handrail cannot pivot, and is maintained in the vertical orientation of FIG. 11.

Figure 12:
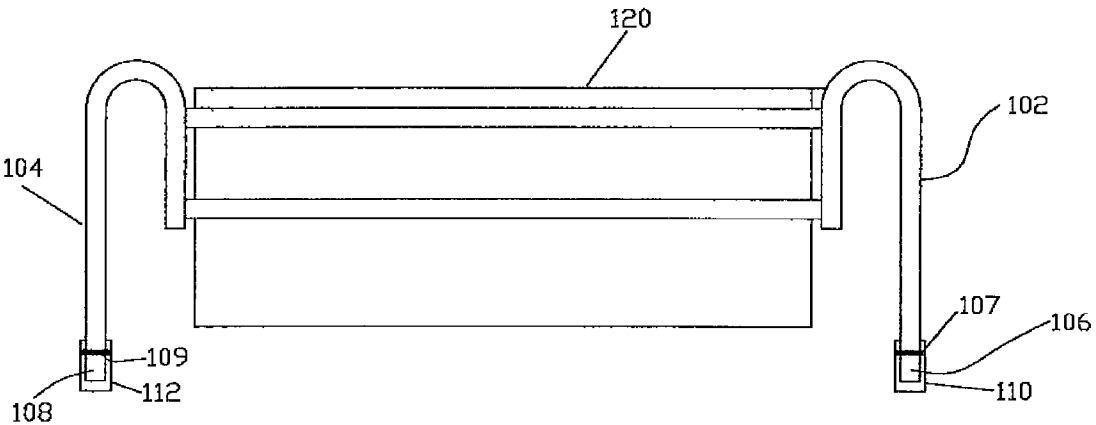
FIG. 12 is a partial side view of a drop hinge attachment of the side rail.

As shown in FIG. 12, the handrail can also include a slide transfer plate 120 which can be attached to the handrail and will provide a slide surface to assist the patient in transferring from the inclined lift to an adjacent bed. There is no requirement for both handrails to have this capability, as the handrails provided either side of the inclined lift are reversible, and therefore the handrail can be located to the appropriate side of the inclined lift.

In an alternate embodiment the slide transfer plate 120 and the siderail are made as a single component where the top edge of the slide transfer plate forms the handrail. Preferably a tubular frame member is provided around the slide transfer plate with the upper edge including at least two spaced notches forming hand grip ports at an upper edge of the slide transfer plate. The drop hinge arrangement for securing of the slide transfer plate to the patient support platform is secured at a lower edge of the slide plate.

The drop hinge can include an elongate slot for receiving a hinge pin fixed to the support platform. With the siderail fully raised in a vertical orientation, the hinge pin is at the bottom of the elongate slot. The siderail can then move downwardly (hinge pin moving to an upper part of the elongate slot) and engage an edge of the patient support frame such that the siderail is secured or locked in the vertical orientation. The rails when raised are pivotal 180° to a suspended non-use position below the patient support platform.

There are other arrangements for securing of the handrail to the inclined lift. For example, these handrails could be supported in the manner similar to handrails provided on hospital beds. These handrails are supported on a hinge mechanism to allow movement downwardly to a clear position and upwardly to the guard position. A suitable arrangement for allowing the pivoting to the 90° configuration will assist in securing of the slide plate 120 and provides a simple mechanism for transferring of a patient from the lift to a bed.

The drop hinge arrangement can also be designed to allow movement of the handrail to a lower position by pivoting through an angle of approximately 180°.

It is preferable that the slide transfer plate 120 be made of an ultra high molecular weight plastic type material to assist in transferring of the patient across the transfer plate.

It can be appreciated from the above description and drawings that the inclined lift provides an effective arrangement for transfer of patients and has particular application for home or domestic use. The inclined extension when the device is not in use can be folded back about the pivot connection and is effectively supported on top of the patient support platform.

The inclined lift may also have application in hospitals and other institutional environments.

Figure 18:
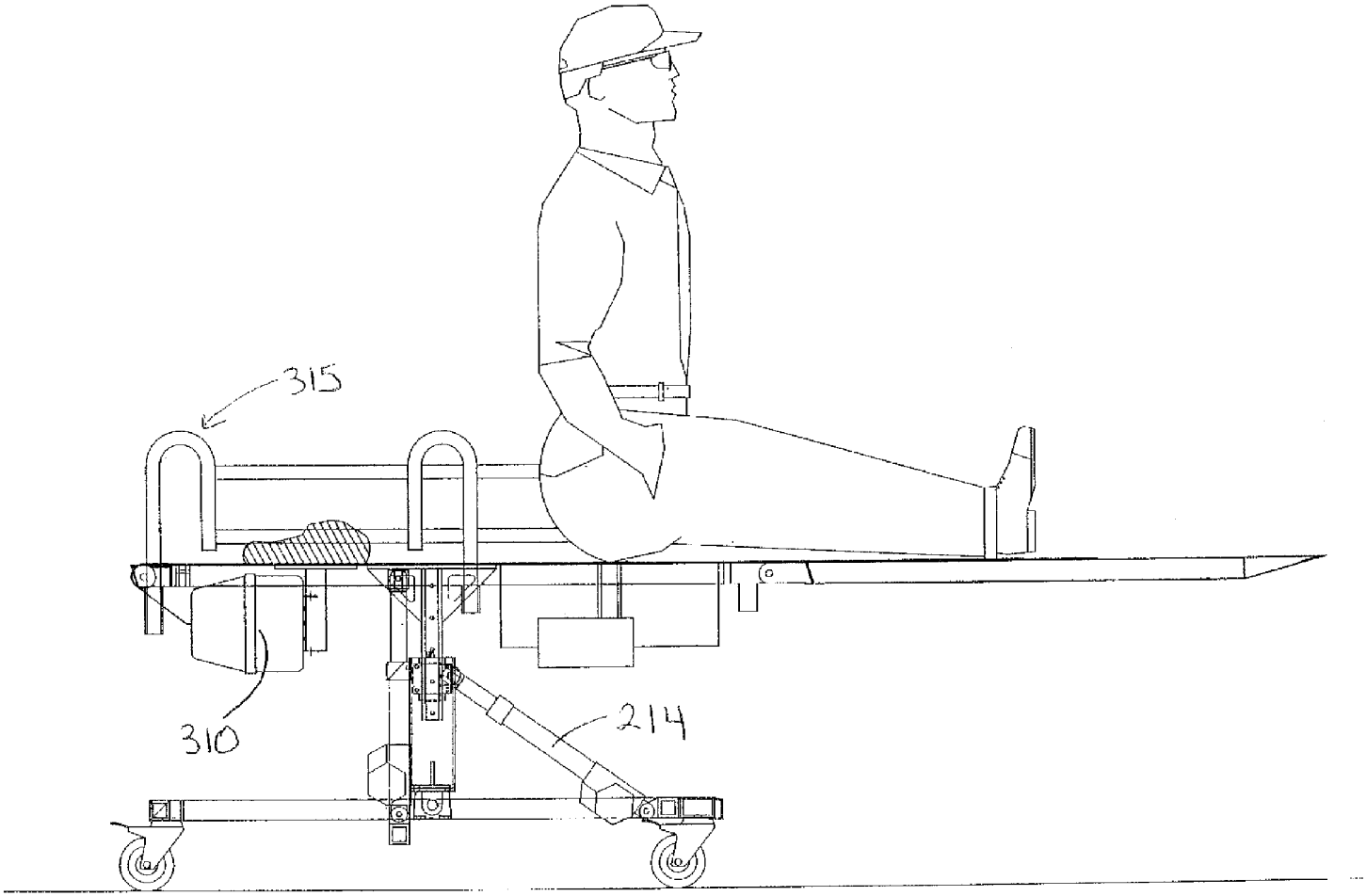
FIG. 18 is a view similar to FIG. 17 where the patient support platform has been raised.
Figure 19:
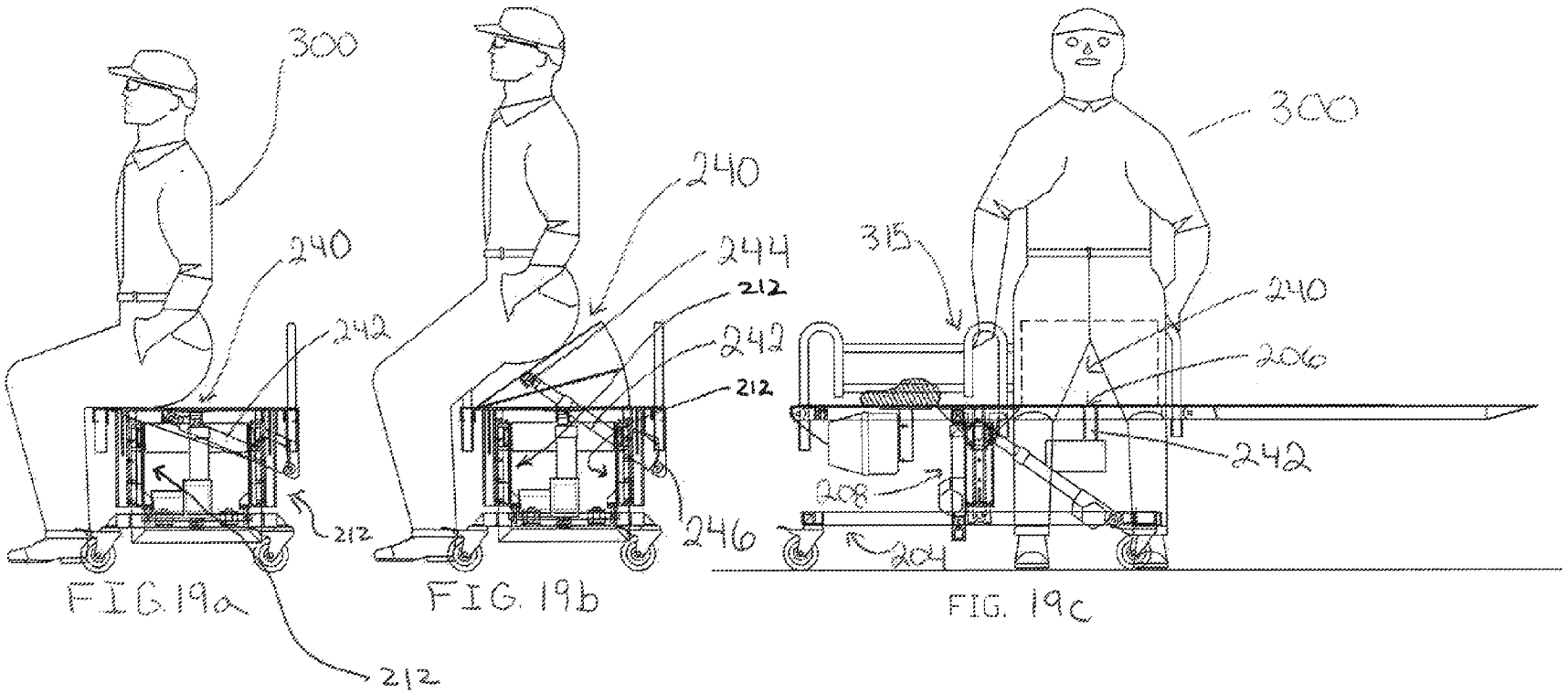
FIGS. 19*a* through 19*c* illustrate a patient boost seat structure for assistance in patient transfer to a standing position.

A variation of the inclined patient lift is shown in FIGS. 13 through 24. In this embodiment, the patient lift includes a central pivoting support frame with the elongate patient support platform provided above the central support frame and movable to different heights. The pivoting central support frame includes a further actuator that allows angling of the patient support platform in the manner described in the earlier embodiment. In addition, the structure of FIGS. 13 through 24 also includes a patient boost system as shown in FIG. 19 for assisting a patient in transferring from a seated position on the platform to a standing position beside the platform.

Figure 13:
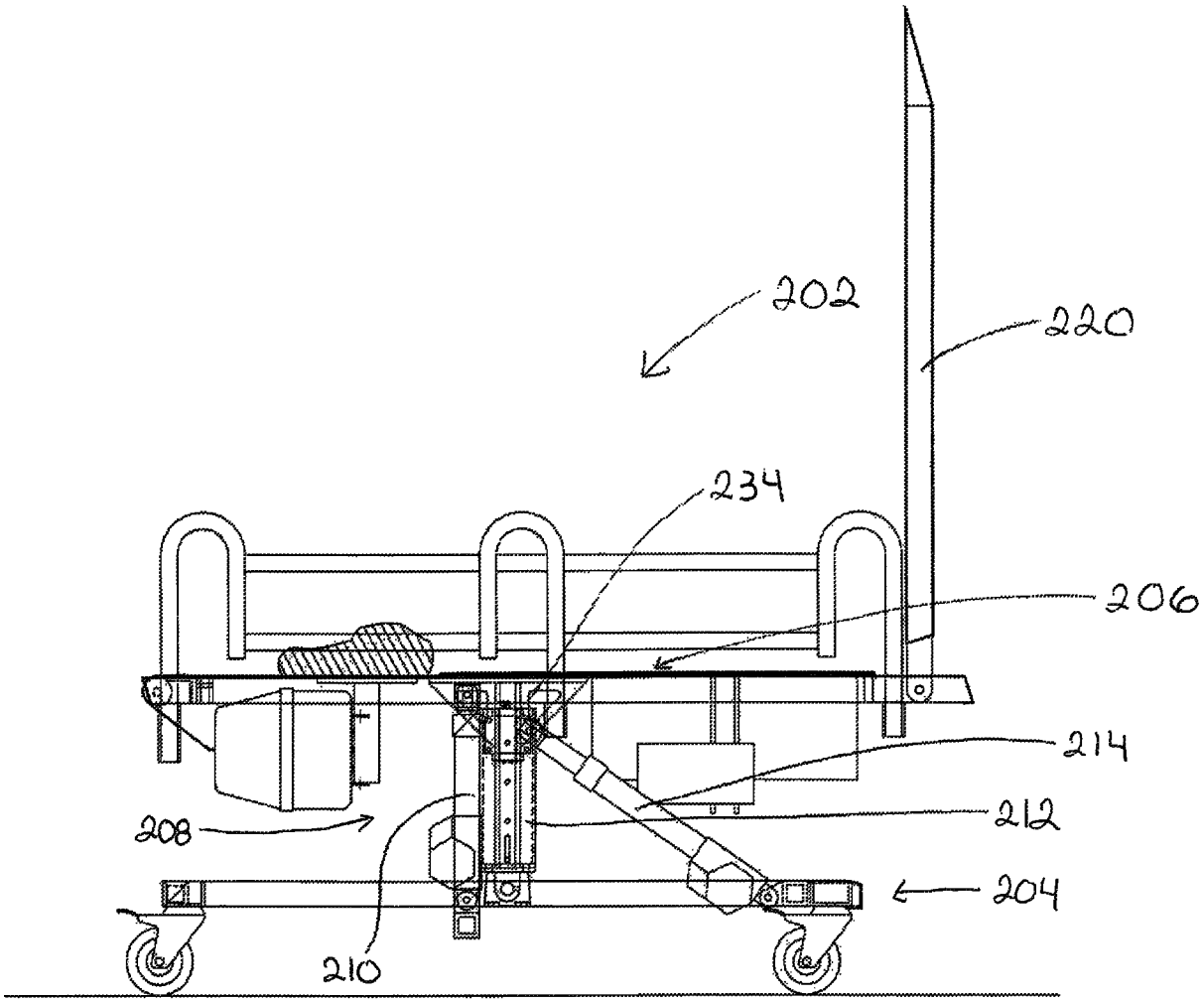
FIG. 13 is a side view of an alternate embodiment.

As shown in FIG. 13, the inclined patient lift 202 includes a base frame 204 that supports the elongate patient support platform 206 at an elevated position. A pivoting adjustable support 208 is positioned between the base frame 204 and the patient support platform 206. The adjustable support 208 includes an electric actuator 210 that, when actuated, can adjust the height of the patient support platform 204 at various heights above the base frame 204. The pivoting adjustable support 208 also includes a pair of telescopic linear adjustable supports 212 positioned to either side of the base frame 206. Gusset type supports 234 reinforce the mechanical connection of the patient support platform 206 to the upper members of the telescopic supports. An angle actuator 214 controls the angle of the pivoting adjustable support frame 208.

Figure 14:
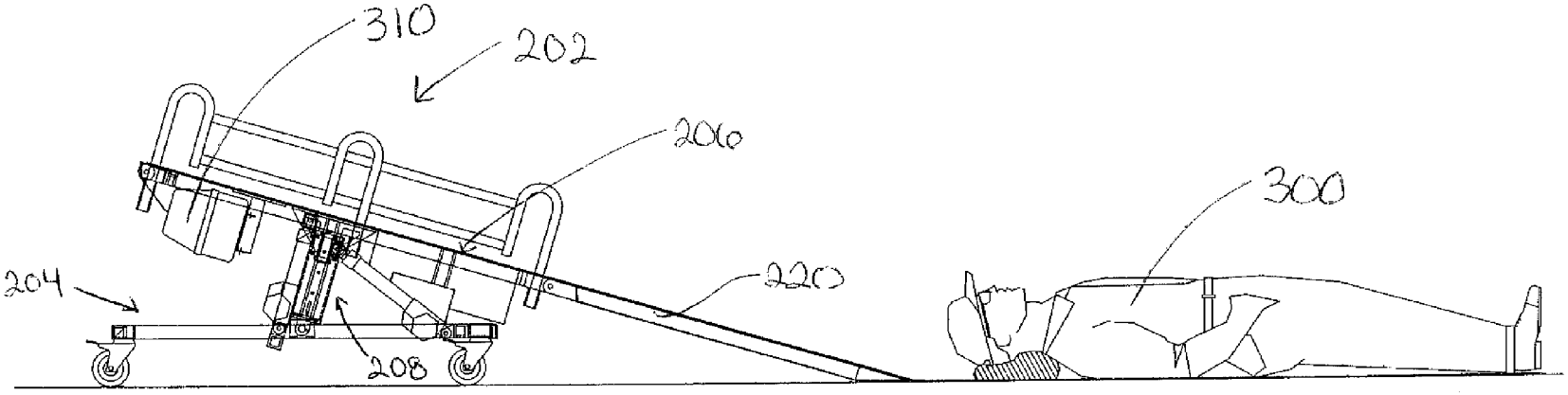
FIG. 14 is a side view of the alternate embodiment in an inclined position.
Figure 15:
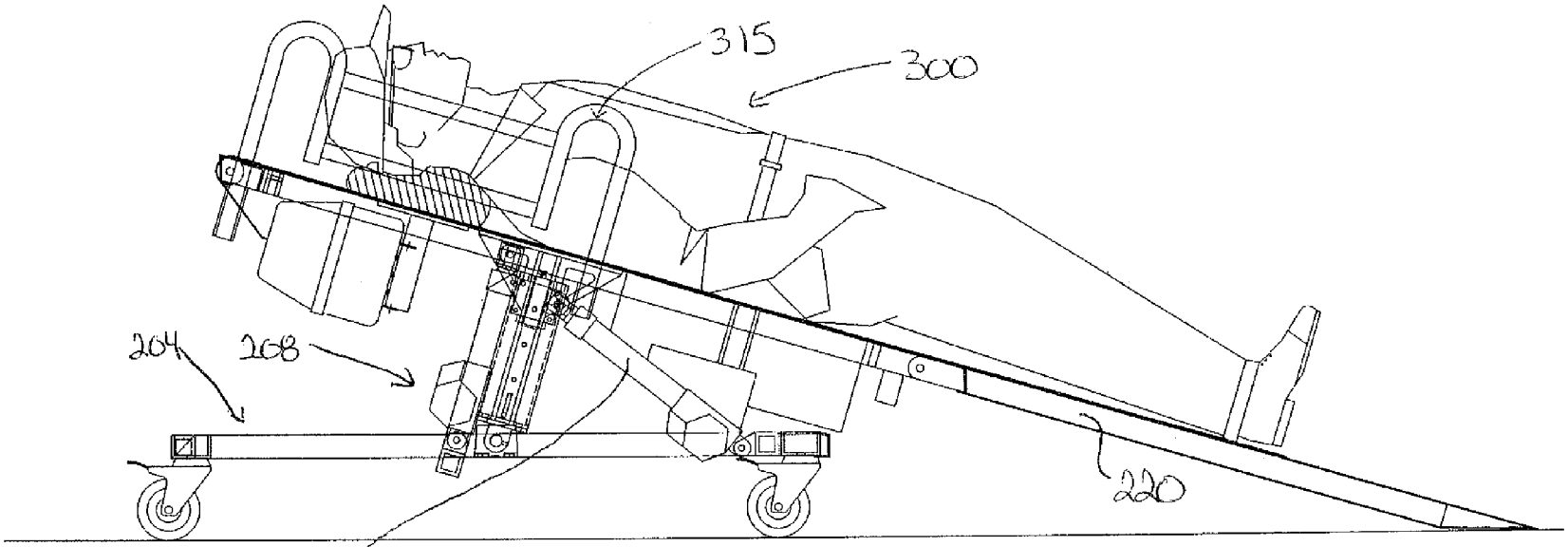
FIG. 15 is a side view of the alternate embodiment in an inclined position with a patient thereon.
Figure 16:
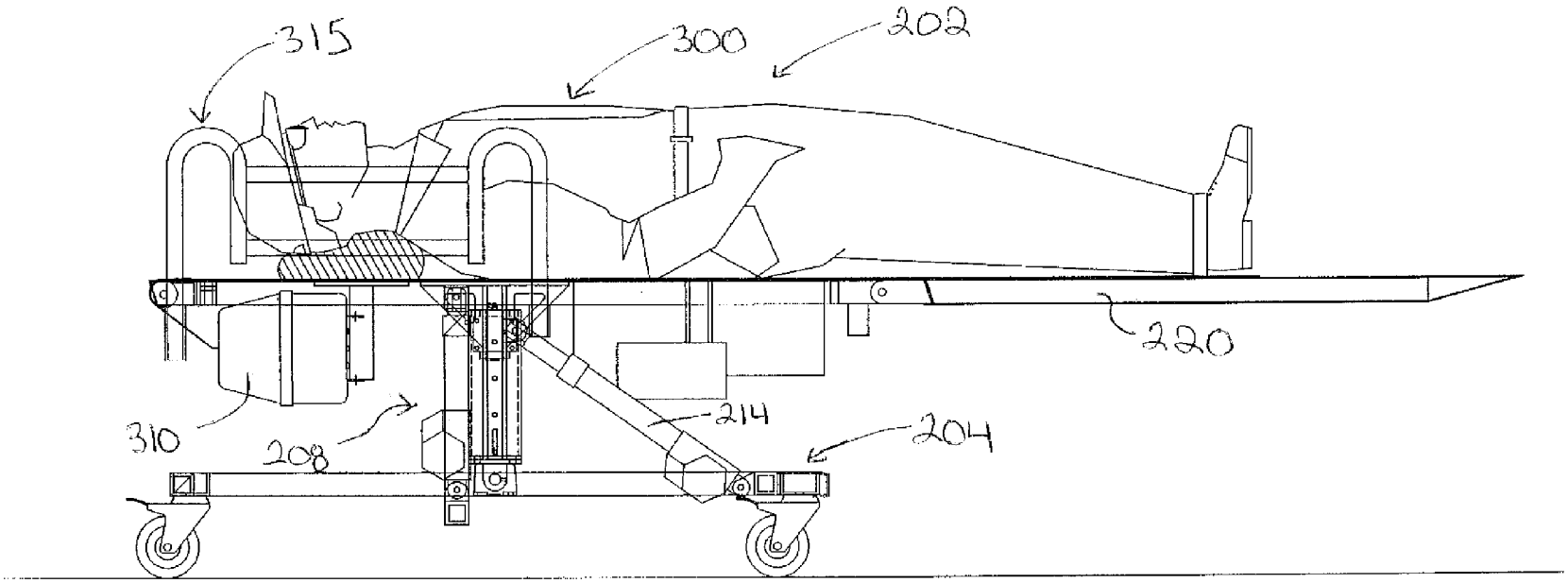
FIG. 16 is a side view of the alternate embodiment with a patient in a horizontal support position.
Figure 17:
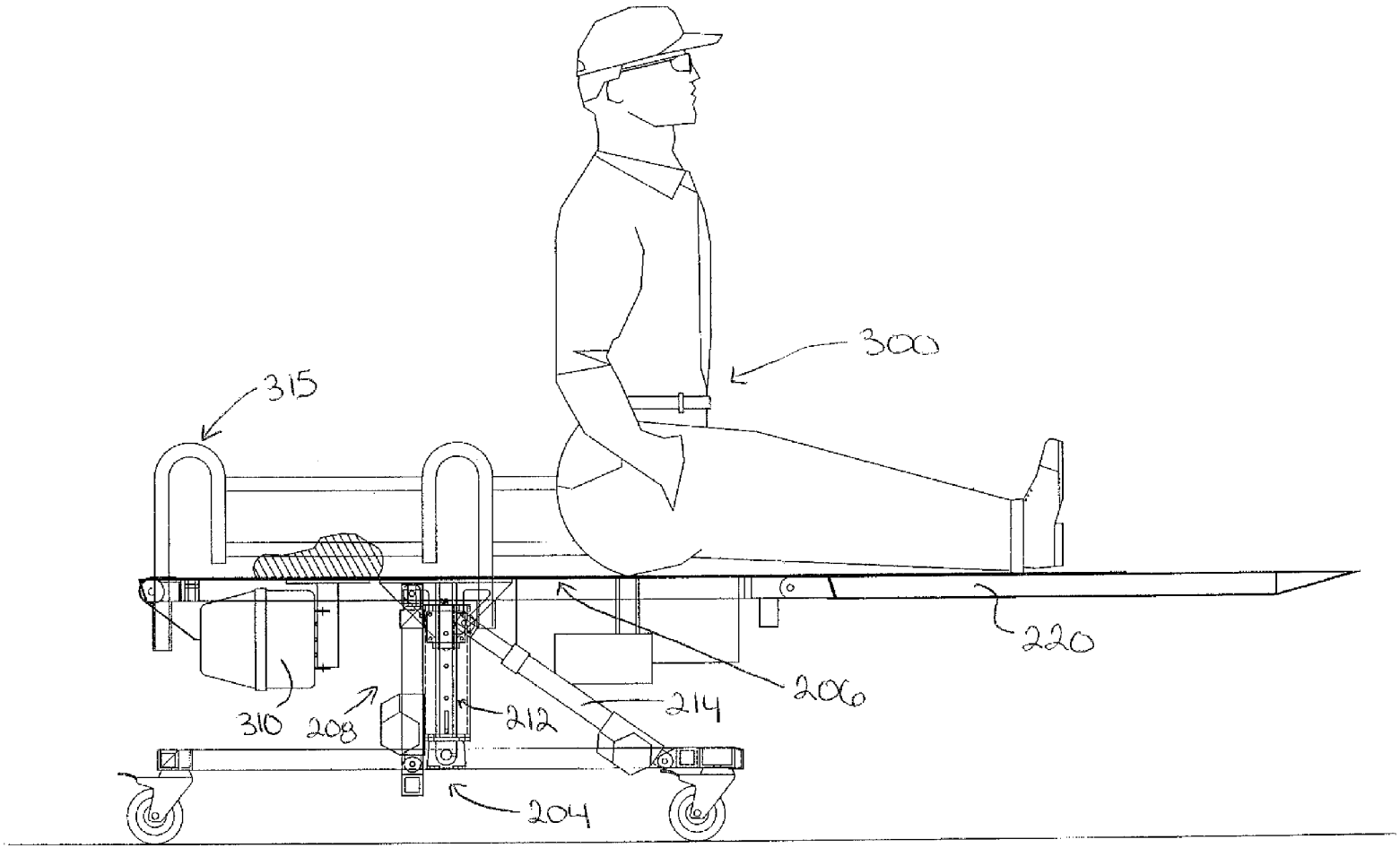
FIG. 17 is a view similar to FIG. 16 with a patient in an upright seated position.

The patient support platform 204 includes a hinged leg and foot support segment 220 which is movable from a vertical type storage position shown in FIG. 13 to an aligned position with the patient support platform as shown in FIGS. 14, 15 and 16. Basically the pivoting foot and leg segment 220 engages the remaining portion of the patient support platform when aligned therewith. In this way, the foot and leg segment 220 is easily moved and maintained in the aligned in use position as shown in FIGS. 14, 15 and 16.

The transfer of a patient on the floor onto the patient support platform is the same as described in earlier embodiments. The patient 300 who has fallen and is now horizontal on the floor is moved onto a mat with the mat being drawn up the inclined patient support platform as shown in FIG. 14 to the position as generally shown in FIG. 15. In order to pull the mat onto the platform, a winch type mechanism 310 is provided under the patient support platform 206. The winch, when actuated, typically by an electric drive arrangement, draws the mat up onto the patient support platform.

As shown in FIGS. 14 and 15, the angle actuator 214 has been controlled to shorten its length and thereby angle the patient support platform 206 downwardly with the foot and leg segment 220 of the patient support platform in engagement with the floor. The angle actuator 214 maintains the patient support platform at this particular orientation. Once the patient 300 has been drawn onto the patient support platform 206 as shown in FIG. 15, it is possible to actuate the angle actuator 214 to return the patient support platform to a horizontal orientation as shown in FIG. 16.

With the inclined patient lift, it is desirable to reduce the height of the patient support platform 206 to the lowest or one of the lower positions whereby the angle of the patient support platform when in engagement with a horizontal support surface is at a relatively low angle. This reduced height assists in stabilizing the unit, reduces the angle and/or reduces the length of the foot and leg segment 220.

Once the patient is in the horizontal position as shown in FIG. 16, the patient support platform 206 can be raised to a more common level as is shown in FIG. 18. Typically the lowest height of the patient support platform 206 is about 18 inches from the floor.

The extension of the angle actuator 214 as shown in FIG. 18 has forced the adjustable support 208 to a generally vertical orientation. The height actuator 210 has been extended to raise the level of the patient support platform. As can be appreciated from a review of FIG. 15, both the height actuator 210 and the intermediate adjustable support 208 pivot as the patient support platform is angled.

FIG. 19 shows a further embodiment of the inclined patient lift that essentially includes a patient boost seat 240 that is movable from a normal position in the plane of the patient support platform to an angled patient boost position shown in FIG. 19*b*. This arrangement assists the patient in standing up by providing a lift to the patient's seat portion. The patient boost seat is provided to one side of the pivoting adjustable support 208 and is a hinged segment that has a hinge axis adjacent a side edge of the patient support platform. The electric actuator 242 has one end 244 attached beneath the patient boost seat and an opposite end 246 supported downwardly from the patient support platform such that the actuator 242 is upwardly angled from the opposite end 246. With this arrangement, extension of the electric actuator 242 will force the patient boost seat to its raised position shown in FIG. 19*b*.

FIGS. 19*a*, 19*b* and 19*c* also illustrate the benefits of the patient boost seat. The required strength for the patient 300 to move to the standing position shown in FIG. 19*c* from the fully seated position shown in FIG. 19*a* can be quite substantial and a caregiver may be required to provide assistance in transferring of the patient 300 to the standing position. Also after a fall the patient may be more reluctant and/or may be of slightly reduced strength.

Figure 20:
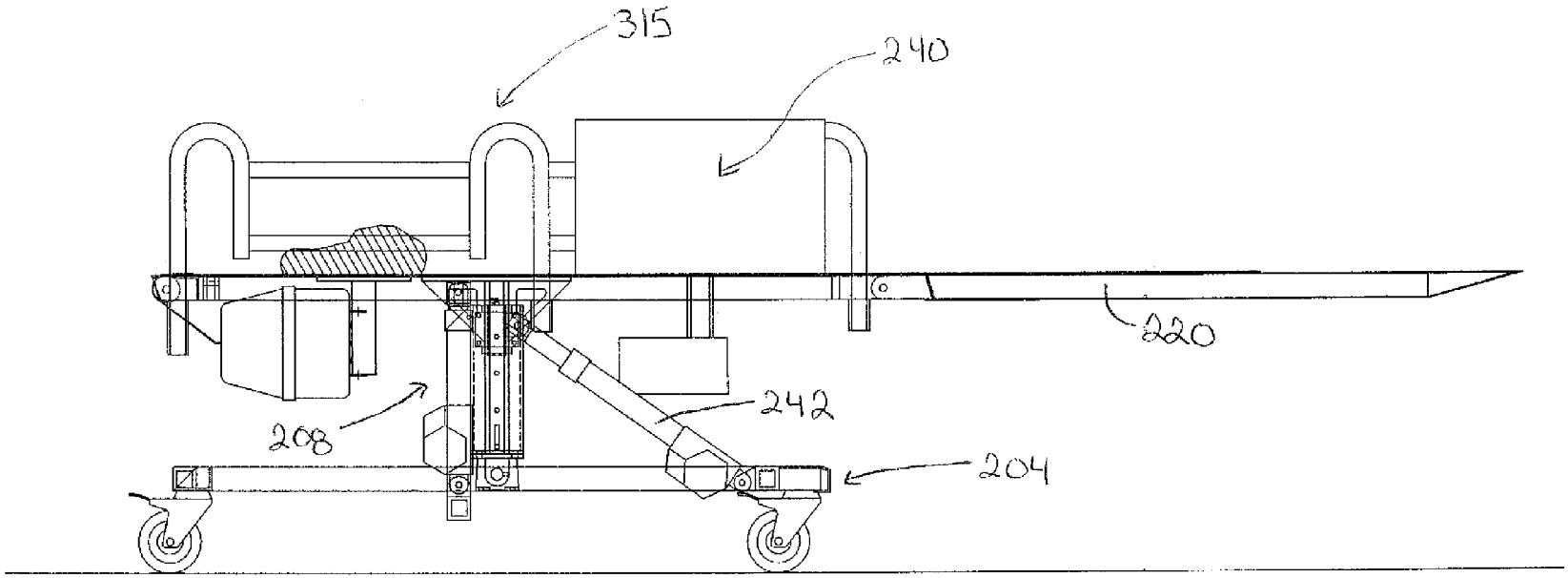
FIG. 20 is a side view of the patient lift device with the patient boost seat in a raised position.
Figure 22:
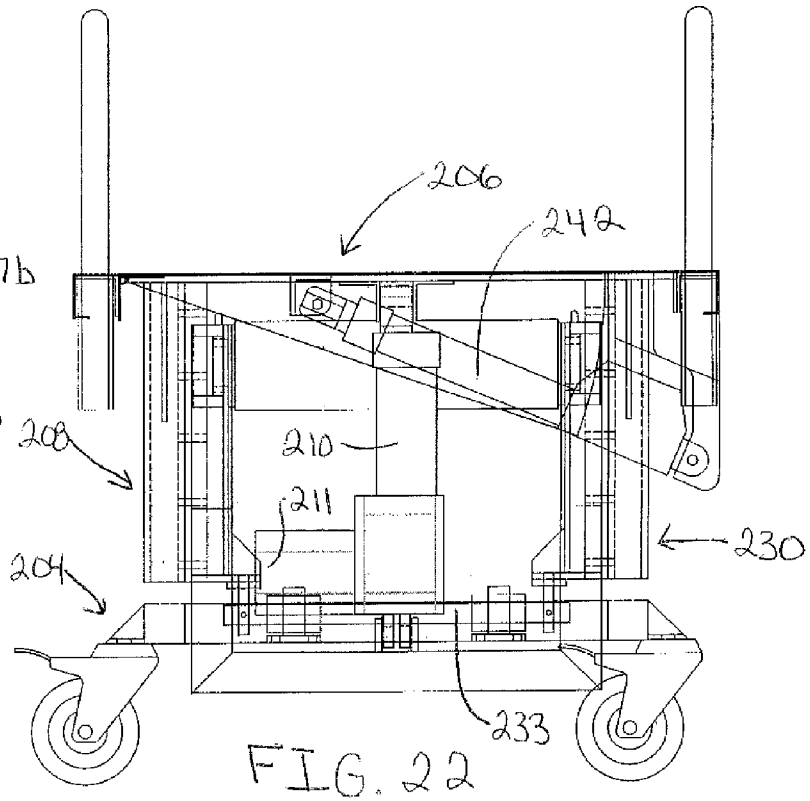
FIG. 22 is an end view of the inclined patient lift in a lowered position.
Figure 21:
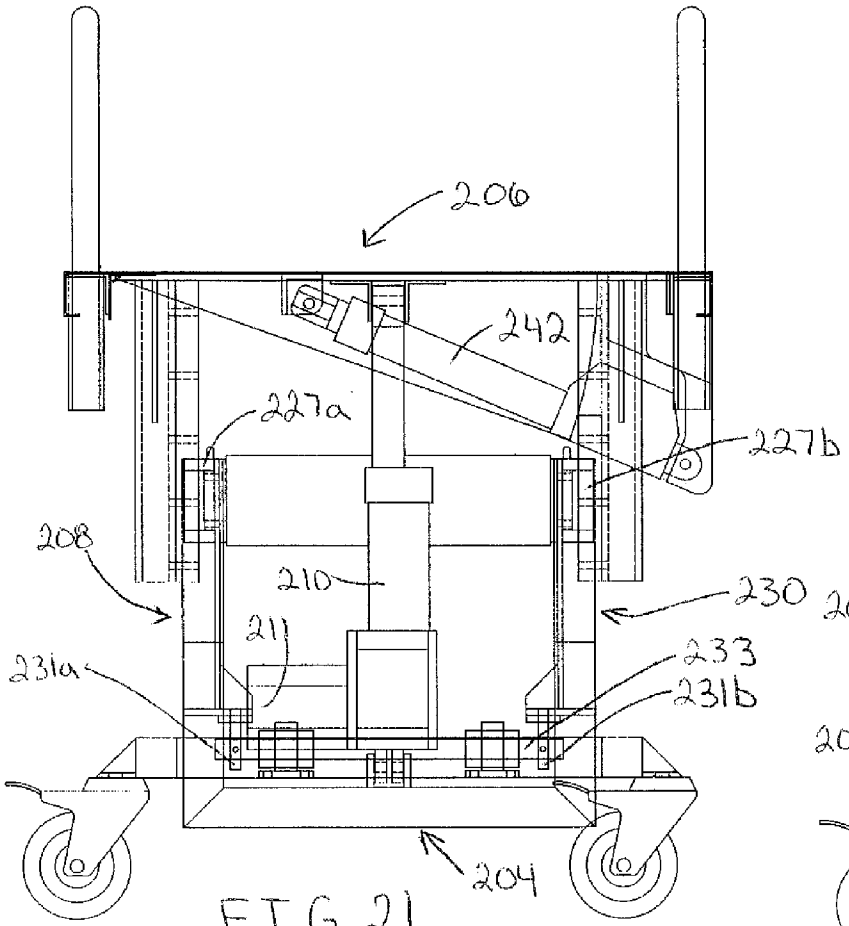
FIG. 21 is an end view with the patient support platform in a raised position.

With the present arrangement, the caregiver can actuate the patient boost seat 240 and the patient is mechanically assisted to a partially raised position such that transfer to the fully standing position shown in FIG. 19*c* is more easily accomplished. Either the patient 300 can control the patient boost seat 240 or a caregiver can operate this arrangement. In any event, the caregiver may not be required to assist the user in moving to the partial standing position shown in FIG. 19*b*. Once the patient has assumed the upright position of FIG. 19*c* the electric actuator 242 can be returned to its normal position shown in FIG. 19*a*. In this case the patient boost seat 240 has returned to, and forms part of the, plane of the patient support platform 206. FIGS. 20, 21 and 22 show further details of the support arrangement. As shown, siderail 315 is of a shorter length and provided forward of the patient boost seat 240. This siderail can continue to be raised and used by a patient for support during transfer to a standing position.

Figure 23:
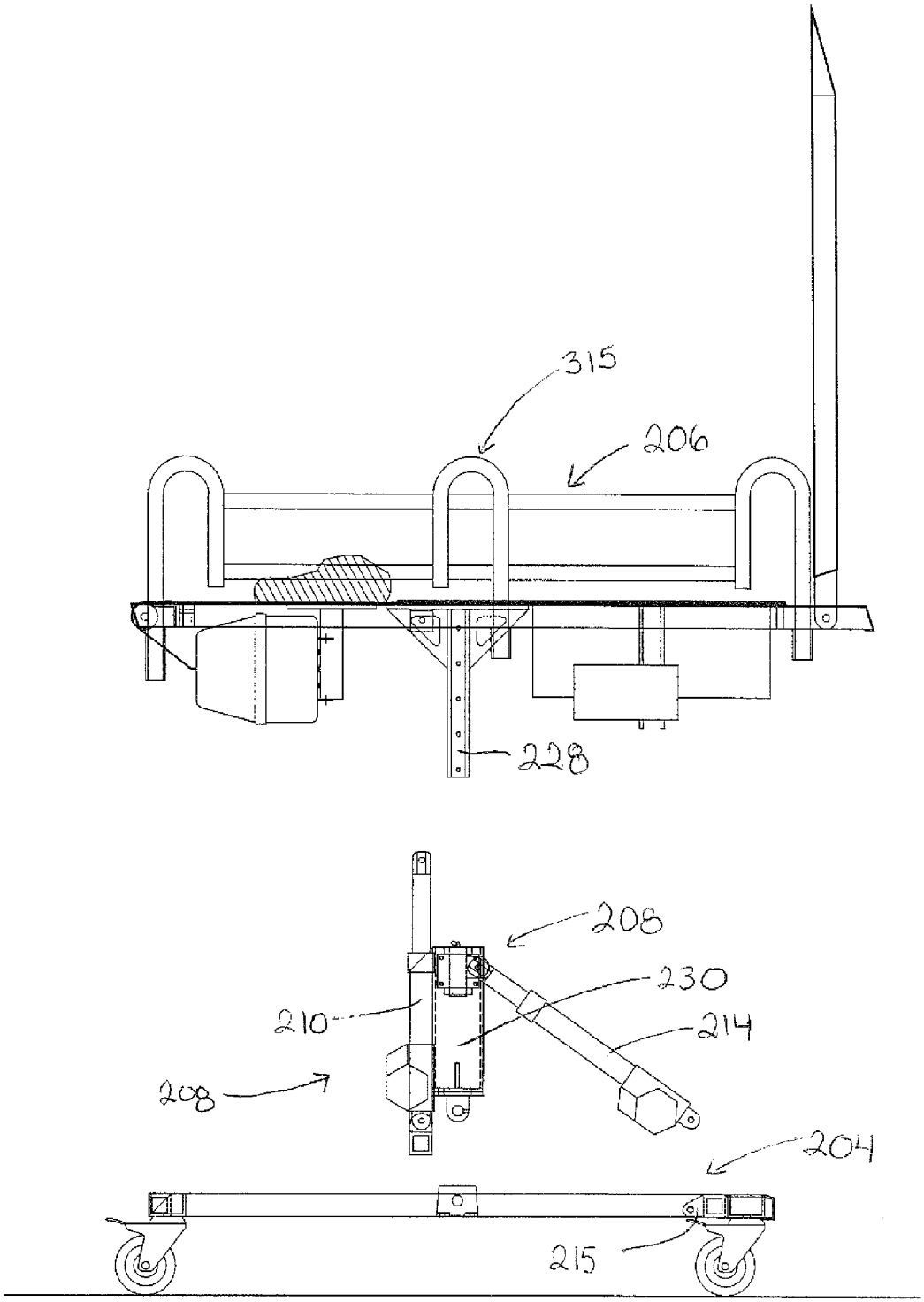
FIG. 23 is an exploded side view showing the 3 main components.
Figure 24:
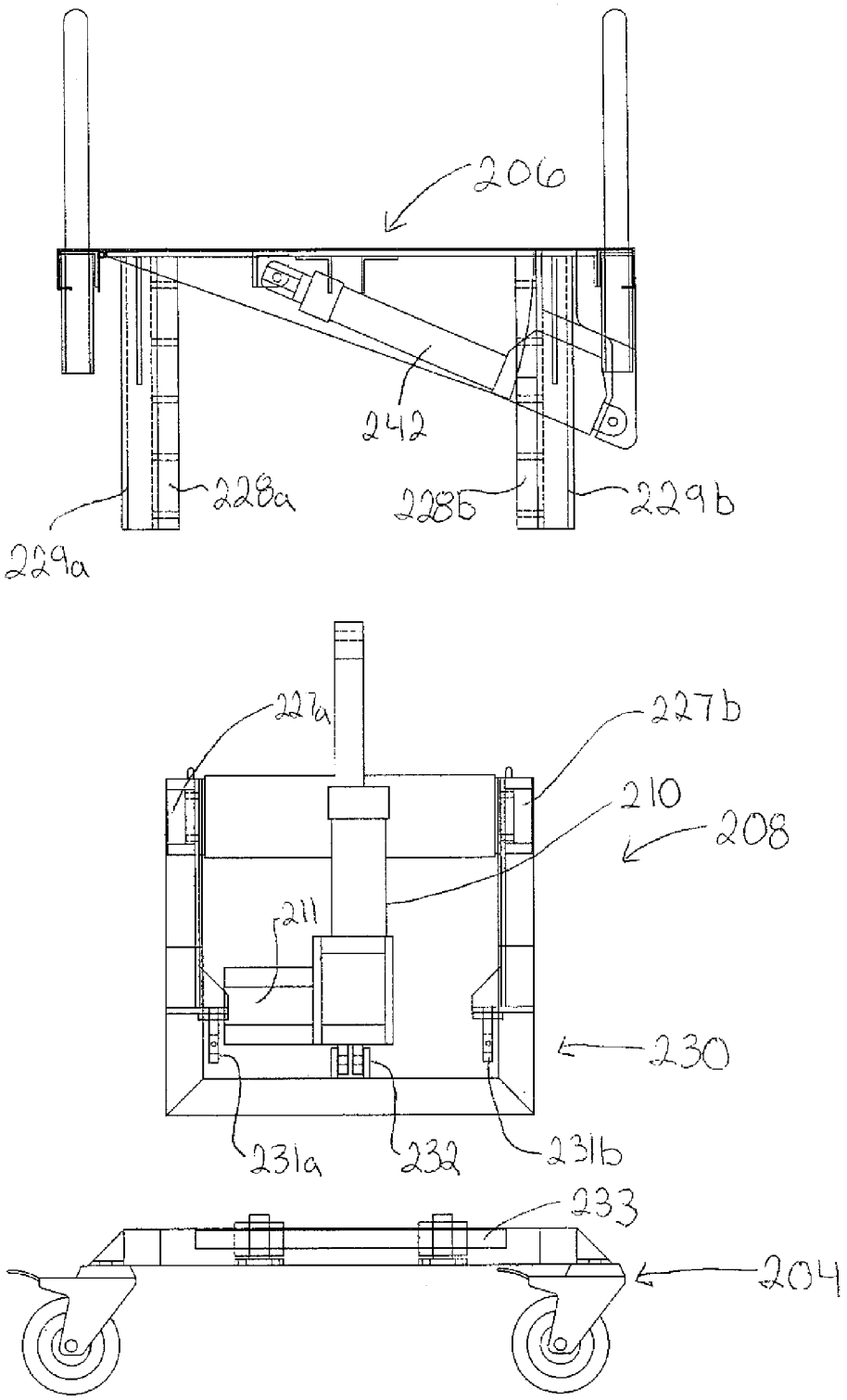
FIG. 24 is an exploded end view of the patient lift.

FIGS. 23 and 24 are exploded assembly type drawings showing the individual components of the inclined patient lift 202 essentially as three different assemblies. There is the base frame 204, the pivoting adjustable support 208 and the patient support platform 206.

The patient support platform 206 can be exposed to significant forces that are transferred by the single central type support, namely the pivoting adjustable support 208 to the base frame. The pivoting adjustable support 208 as shown in FIG. 24 includes its own support frame 230. This frame pivotally supports the height actuator 210 at the central pivot 232. In this way the height actuator 210 as well as its electric drive arrangement 211 are directly supported on the frame 230. The frame 230 includes bearings 231*a* and 231*b* which engage and are attached to the pivoting shaft 233 supported on the base frame 204. The support frame 230 includes adjustable linear members on opposite sides of the support frame. The linear adjustable support members include upper bearings shown as 227*a* and 227*b* at an upper portion of the support frame 230 which receive the high strength rod members 228*a* and 228*b* that extend downwardly from and are attached to the patient support platform 206. This attachment is by engagement with the separate tube members 229*a* and 229*b* that are rigidly secured to the patient support platform 206 by the gusset members 234. A series of bolts shown in dashed line fixedly attach the rod members 228 to the tube members 229. Basically the rod members are hardened steel and in combination with the upper slide bearings 227*a* and 227*b* strongly secure and support the patient support platform 206 above the base frame 204. The support frame 230 is able to maintain its alignment beneath the patient support platform and the height of the patient support platform is adjusted by controlling the position of the rod members relative to the bearings.

As shown in FIG. 24 the patient actuator 242 can be secured to the patient support platform as part of a subassembly and the various subassemblies simplify the manufacture of the patient lift.

The rod member 228*a* as shown in FIG. 23 is received within the upper slide bearing 227*a* and thus the support frame 230 will be slideably supported beneath the patient support platform 206. The angle actuator and its engagement with the support frame 230 and the base frame is also clearly shown. The actuator 214 has its lower end and electric actuator connected to the base frame at the pivot connection 215.

It is preferred that the inclined patient lift include 24 volt electric actuators whereby the height of the patient support platform 206 can be raised and lowered above the base frame 204 by the extension of the height actuator 210. As the height actuator 210 is extended the rod members 208 slide within the bearings 227 while maintaining a strong connection of the patient support platform above the base frame 204. It is also preferred that the winch 310 is electrically actuated, although a manual crank arrangement could be used. Typically the base frame 204 will include one or more 24 volt electric batteries for operating the various actuators and the winch 310.

It has been found that the patient lift as shown and described advantageously allows a single caregiver to safely assist a patient who has fallen to the floor. Basically the patient on the floor can shift themselves or the caregiver can help position them on a slideable mat. The slideable mat is then drawn onto the inclined patient support platform at which time the patient support platform is returned to a horizontal position. Once in the horizontal position it can be raised or lowered to suit the particular height of the patient should the patient wish to be transferred to a standing position. The patient support platform can be appropriately raised and the boost seat 240 can again assist the patient in assuming a standing position to one side of the structure. The patient boost seat 240 is to one side of the pivoting adjustable support 208. It can also be seen from the drawings that the side rail provided to the side of the patient support platform that includes the hinge of the patient boost seat, is not as long as the full rail provided to the opposite side. With this arrangement the short side rail stops short of the patient boost seat and the rail can be maintained in a raised position. The upper surface of the side rail can be used by the patient to maintain balance as he is transferred to the standing position.

The present inclined patient lift arrangement provides an effective solution for a caregiver in a private home to deal with the difficult issue of transferring a patient who has fallen from the floor to a raised position. Although the application describes the return of the patient to a standing position, the inclined lift can also be used to transfer a patient to a normal bed or to a chair.

Other more sophisticated arrangements have been previously proposed, however these arrangements are not as convenient to use or as cost effective to manufacture. The present arrangement provides a practical solution for in-home care as well as care within long term care facilities. It can be appreciated that one of these inclined patient lifts can be available within a premise and if a patient falls a single caregiver can assist the patient in being transferred from the floor to a raised position. Once in the raised position, transfer can be made to a wheelchair, bed or other arrangement.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An inclined lift for patient transfer comprising a base frame supporting an elongate patient support platform and movable between an inclined position and an elevated position, said inclined position having one end of said elongate patient support platform adjacent ground level and the opposite end at a raised level and said raised position having both ends of said platform at an elevated position at least 15 inches above ground level; said inclined lift further including a retraction mechanism with a free end thereof attached to a patient support arrangement, said retraction mechanism being operative to draw said patient support arrangement from ground level in front of said platform when in said inclined position onto said inclined platform and movable to said raised position; and wherein said patient support platform includes an elevating mechanism disposed between and connecting said base frame and said patient support platform and operable to vertically raise and lower said platform to adjust the height of the platform; said elevating mechanism being secured to said platform and including a pivot securement supported by and extending across said base frame; said inclined lift further including an adjustable actuator extending at an angle between said base frame and said elevating mechanism with one end of said adjustable actuator connected to said base frame at one end thereof and an opposite end of said adjustable-actuator connected to said elevating mechanism at a raised position relative to said base frame; said adjustable actuator when adjusted cooperating with said elevating mechanism to pivot said elevating mechanism about said pivot securement to said base frame causing angular movement of said patient support platform between said elevated position and said inclined position; said patient support platform further including a patient standup boost arrangement, said patient standup boost arrangement comprises a patient seat that in a first position is aligned with and forms part of said patient support platform, said patient seat including a front edge pivotally supported along one side of said patient support platform and pivotally movable about said front edge by a separate actuator located below said patient support platform to a second angled position with a rear edge of said patient seat raised above said patient support platform.

2. An inclined patient lift as claimed in claim 1 wherein said elevating mechanism includes a single electrical actuator centrally located in a width of said base frame and said elevating mechanism includes a pair of linear guides located on opposite sides of said patient support platform.

3. An inclined patient lift as claimed in claim 1 wherein said separate actuator has one end attached to said patient support platform on a first side of said platform opposite said front edge of said patient seat and said separate actuator is upwardly angled with an opposite end attached to said patient seat to pivot said patient seat about said front edge with movement of said separate actuator.

4. An inclined patient lift as claimed in claim 3 wherein said patient support platform includes a displaceable full length side rail on said first side of said patient support platform and a non full length displaceable side rail on the side of said patient support platform that includes said pivotally supported front edge of said patient seat.

5. An inclined patient lift as claimed in claim 4 wherein said patient support platform at a foot end to one side of said patient seat includes a hinged portion that is pivotally supported to the remaining portion of said patient support platform and is pivotally movable from an in use aligned position to an upright storage position approximately perpendicular to the remaining portion of said patient support platform.

6. An inclined patient lift as claimed in claim 1 wherein said retraction mechanism is a winch type arrangement.

7. An inclined patient lift as claimed in claim 1 wherein said patient support arrangement is a flexible mat with a draw bar member at one end thereof attachable to said retraction mechanism.

8. An inclined patient lift as claimed in claim 7 wherein, said flexible mat at an end thereof adjacent said draw bar member has a series of strip portions extending in the length of said flexible mat a sufficient distance to assist in removal of said mat supporting a patient of said platform by removal of said draw bar member and removal of said strips located between the patient and said platform.

9. An inclined patient lift as claimed in claim 7 wherein said flexible mat at an end thereof adjacent said draw bar member has a series of strip portions extending in the length of said flexible mat a sufficient distance to assist in removal of said mat supporting a patient on said strip portions by progressive removal of said strips.

10. An inclined patient lift as claimed in claim 9 wherein said strips extend at least 20 inches in the length of said mat and are joined by said draw bar member which is removable to allow said progressive removal of said strips.

11. An inclined lift as claimed in claim 5 wherein said opposite end of said patient support platform is vertically adjustable relative to said base frame.

12. An inclined lift as claimed in claim 11 wherein said opposite end of said patient support platform is open to accommodate transfer of a patient at a raised position of said platform to a further support structure by movement of said along said platform and through said opposite end.

13. An inclined lift as claimed in claim 12 including a second elevating mechanism for vertical adjustment of said one end of said patient support platform relative to said base frame.

14. An inclined lift as claimed in claim 5 including removable side rails located on opposite sides of said patient support platform.

15. An inclined lift as claimed in claim 12 wherein said elevating mechanisms include a remote actuator for operating thereof.

16. An inclined lift as claimed in claim 5 wherein said patient support platform includes a movable extension secured to said patient support platform and projecting beyond said base frame forming said one end of said patient support platform.

17. An inclined lift as claimed in claim 16 wherein said movable extension is pivotally secured to said patient support platform.

18. An inclined lift as claimed in claim 17 wherein said base frame includes four wheels supporting said base frame.

19. An inclined lift as claimed in claim 18 wherein said base frame supports said retraction mechanism and said elevating mechanisms.

* * * * *